US006622627B2

(12) United States Patent
Sansolo

(10) Patent No.: US 6,622,627 B2
(45) Date of Patent: Sep. 23, 2003

(54) ACTUATOR APPARATUS

(76) Inventor: Arie Sansolo, 19 Harel Street, Afridar, Ashkelon 78649 (IL)

( * ) Notice: Subject to any disclaimer, the term of this patent is extended or adjusted under 35 U.S.C. 154(b) by 10 days.

(21) Appl. No.: 10/013,355

(22) Filed: Dec. 13, 2001

(65) Prior Publication Data

US 2003/0110970 A1 Jun. 19, 2003

(51) Int. Cl.[7] ..... F42D 3/00; F42B 3/00; F42B 3/10; F42B 3/12; F42B 3/18; F42C 11/00; F42C 15/00; F42C 19/00; F42C 19/12; F23Q 21/00; F23Q 7/02

(52) U.S. Cl. ..... 102/202.12; 102/202.1; 102/202.2; 102/202.9; 102/202.14; 102/217; 102/322; 102/331

(58) Field of Search ..... 102/202.12, 202.14, 102/331, 322, 202, 1, 202.2, 202.9, 217

(56) References Cited

U.S. PATENT DOCUMENTS 2,674,945 A * 4/1954 Marsh ..... 102/202.12
3,851,589 A * 12/1974 Meyer ..... 102/70.2 R
4,825,765 A * 5/1989 Ochi et al. ..... 102/206
5,470,256 A * 11/1995 Waldock ..... 439/501
5,932,832 A * 8/1999 Hansen et al. ..... 102/202.4
6,082,264 A * 7/2000 Meyer et al. ..... 102/202.9

* cited by examiner

*Primary Examiner*—Michael J. Carone
*Assistant Examiner*—H. A. Blackner
(74) *Attorney, Agent, or Firm*—David Klein; Dekel Patent Ltd.

(57) ABSTRACT

Actuator apparatus comprising an actuator including an at least partially hollow housing, a cap element removably mountable on the actuator, and a coil of electrical wire disposed inside the housing, a first portion of the coil being arranged for electrical connection with an electrical connector separate from the actuator and a second portion of the coil being arranged for electrical connection with the cap element, the coil being unwindable outwards from the housing.

8 Claims, 5 Drawing Sheets

ACTUATOR APPARATUS

FIELD OF THE INVENTION

The present invention relates generally to remote actuator apparatus, e.g., apparatus that enables quick and safe connection and unwinding of a wound coil of wire or the like, such as to detonate explosive charges from a remote location.

BACKGROUND OF THE INVENTION

Detonators for detonating an explosive charge are used in many applications, such as but not limited to, police or military units that dismantle bombs or blow up buildings and other objects, pyrotechnical applications (e.g., construction crews that are required to blast areas to make way for constructing buildings and roads). Some detonators are actuated electrically by an actuator, which may receive signals from a control device, and which generates an electrical signal to operate the detonator. For safety reasons, it is important that the person actuating the detonator be far from the explosive charge as possible. Accordingly, some detonator systems include a long length of coiled electrical wire, one end of which may be connected to the actuator and the other end of which may be connected to the detonator or explosive charge.

However, the electrical connections required to connect the actuator-wire-detonator system generally take a long time. This may be of little importance in construction work, but it is critical in military or police applications to work as fast as possible. Accordingly, it would be desirable to provide an actuator-wire-detonator system that is safe, reliable and quick to operate.

SUMMARY OF THE INVENTION

The present invention seeks to provide remote actuator apparatus which may be used in an actuator-wire-detonator system. The actuator apparatus enables rapid and safe connection and unwinding of a wound coil of wire or the like, such as to detonate explosive charges from a remote location. The wire may be coiled in an at least partially hollow actuator housing, and unwinds rapidly without snagging. The actuator may be electrically connected to a control device with one quick motion, such as with quick-connect male and female electrical connectors. The control device may serve as the power source for the actuator. The invention may include additional safety features, such as a safety switch to operate the control device and a safety pin which must be removed before actuation of the actuator.

The housings of the control device and actuator may be shielded from EMI (electromagnetic interference), so as to prevent spurious signals from other electrical devices, telecommunication devices, lightning and the like, in the vicinity of the actuator system from interfering with the operation of the actuator system.

Power sources of prior art systems generally require a capacitor to attain the necessary charge to actuate the detonator. The build-up of charge in the capacitor means that there is a time delay in actuation of the detonator. In a preferred embodiment of the present invention, suitable for many military and police applications, the remote actuator apparatus may be operated with a power source, e.g., dry battery, that requires no capacitor to build up charge. This provides a further advantage over the prior art, because there is no time delay associated with a capacitor.

There is thus provided in accordance with a preferred embodiment of the present invention actuator apparatus comprising an actuator including an at least partially hollow housing, a cap element removably mountable on the actuator, and a coil of electrical wire disposed inside the housing, a first portion of the coil being arranged for electrical connection with an electrical connector separate from the actuator and a second portion of the coil being arranged for electrical connection with the cap element, the coil being unwindable outwards from the housing.

In accordance with a preferred embodiment of the present invention the first portion of the coil is in electrical communication with a quick-connect electrical connector.

Further in accordance with a preferred embodiment of the present invention the quick-connect electrical connector is adapted to be connected to a corresponding electrical connector with a motion in one direction.

Still further in accordance with a preferred embodiment of the present invention the quick-connect electrical connector includes one of a male and female electrical connector pair.

In accordance with a preferred embodiment of the present invention the apparatus further includes a control device adapted to be electrically connected to the actuator. The control device and the actuator preferably include mating quick-connect electrical connectors adapted to bring the control device and the actuator into electrical communication with one another.

Further in accordance with a preferred embodiment of the present invention the control device includes a power source adapted to provide power for the actuator.

Still further in accordance with a preferred embodiment of the present invention at least one of the quick-connect electrical connectors is electrically shorted until the connectors are mated.

In accordance with a preferred embodiment of the present invention at least one detonator is disposed in the cap element.

Further in accordance with a preferred embodiment of the present invention the apparatus further includes a safety switch adapted to operate the control device. The safety switch may include a plurality of switches and different combinations of throwing the plurality of switches may correspond to different functions of the control device.

Still further in accordance with a preferred embodiment of the present invention the apparatus further includes a safety pin having first and second positions, wherein in the first position the safety pin substantially prevents actuation of the actuator apparatus and wherein in the second position the safety pin permits actuation of the actuator apparatus.

In accordance with a preferred embodiment of the present invention the housing of the actuator and/or control device is shielded from EMI (electromagnetic interference).

Further in accordance with a preferred embodiment of the present invention the power source provides power for actuating the actuator free of a capacitor.

There is also provided in accordance with a preferred embodiment of the present invention an actuator-wire-detonator system including an actuator including an at least partially hollow housing, a coil of electrical wire disposed inside the housing, the coil being unwindable outwards from the housing, and a control device electrically connectable to the actuator and the coil.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
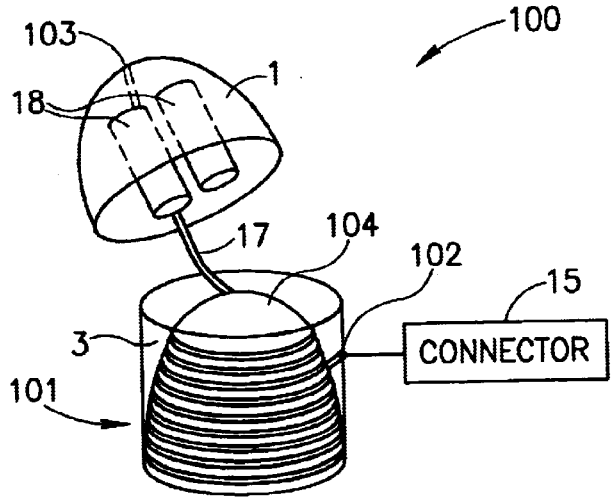
FIG. 1 is a simplified pictorial illustration of actuator apparatus, constructed and operative in accordance with a preferred embodiment of the present invention, with a coil of wire disposed in a housing.
Figure 2:
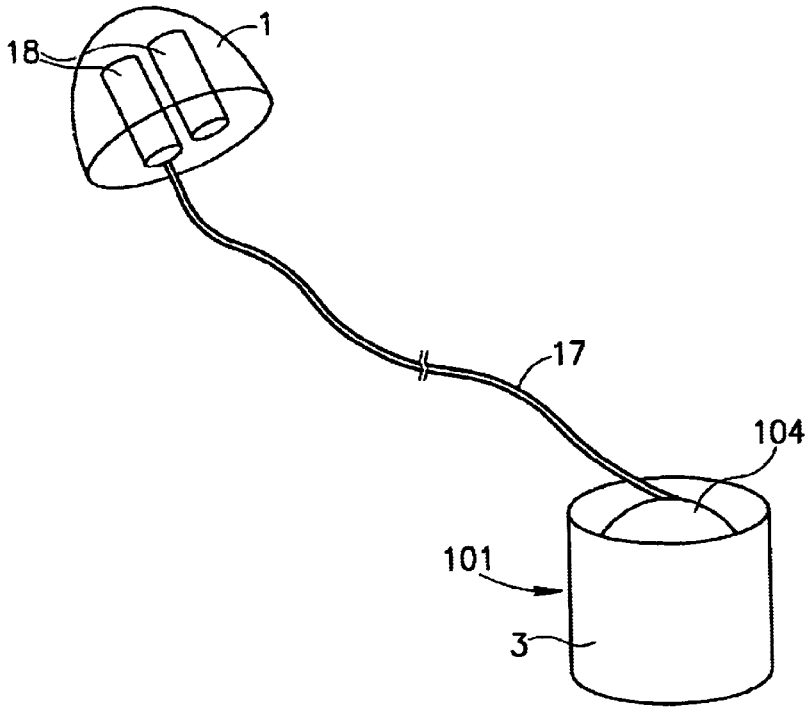
FIG. 2 is a simplified pictorial illustration of the actuator apparatus of FIG. 1 with the coil of wire deployed and pulled out of the housing.

Reference is now made to FIGS. 1 and 2, which illustrate actuator apparatus 100, constructed and operative in accordance with a preferred embodiment of the present invention.

Actuator apparatus 100 preferably includes an actuator 101 comprising an at least partially hollow housing 3. A cap element 1 is preferably removably mountable on actuator 101. The cap element 1 may be, for example, snapped onto actuator 101 or may be screwed thereon. The cap element 1 preferably forms a watertight seal with actuator 101 when assembled thereon.

A coil 17 of electrical wire is preferably disposed inside housing 3. A first portion of the coil 17 is preferably arranged for electrical connection with an electrical connector 15 (shown simplistically as a "black box" in FIG. 1), which is separate from the actuator 101. For example, the first portion of the coil 17 may be one end of the wire with a terminal 102 mounted on a surface of the housing 3. Terminal 102 may be electrically connected to a power source (not shown in FIG. 1) via connector 15. A second portion of the coil 17 is preferably arranged for electrical connection with the cap element 1. For example, the second portion of the coil 17 may be an opposite end of the wire with a terminal 103 mounted on a surface of the cap element 1. One or more detonators 18 (or explosive charges) may be disposed in the cap element 1, to which terminal 103 may be electrically connected, as shown in FIG. 1. Alternatively, instead of detonators, terminal 103 (or a plurality of terminals 103) may be electrically connected to one or more electrical devices, such as but not limited to, tactical or military devices, missiles, rockets and others.

The actuator 101 and housing 3 may be of any size or shape. The wire of coil 17 may be any suitable electrical wire, such as but not limited to, a single wire, double wire, or wire bundle, of any length, such as but not limited to, 10–50 meters. The coil 17 may be wound about a mandrel 104, as seen in FIG. 1, which may be conical or any other shape. Referring to FIG. 2, the coil 17 may be easily and rapidly pulled out of the housing 3 by pulling cap element 1 away from the housing 3, and the wire unwinds outwards from the housing 3 preferably without snagging. The cap element 1 may be placed on or attached to an object that it is desired to explode.

Figure 3A:
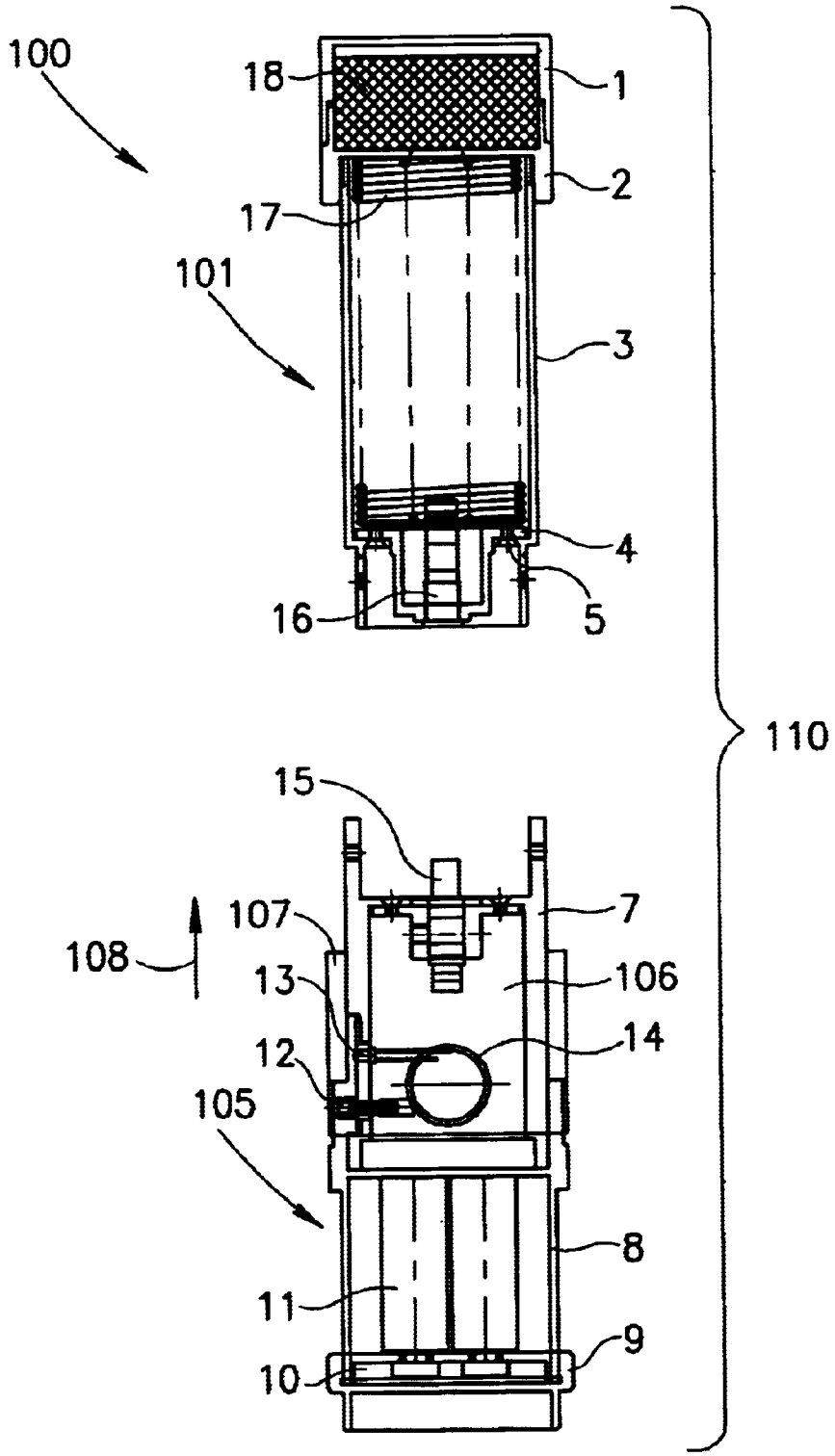
FIGS. 3A and 3B are simplified exploded and pictorial illustrations, respectively, of the actuator apparatus of FIG. 1 incorporated into an actuator-wire-detonator system, in accordance with a preferred embodiment of the present invention.
Figure 3B:
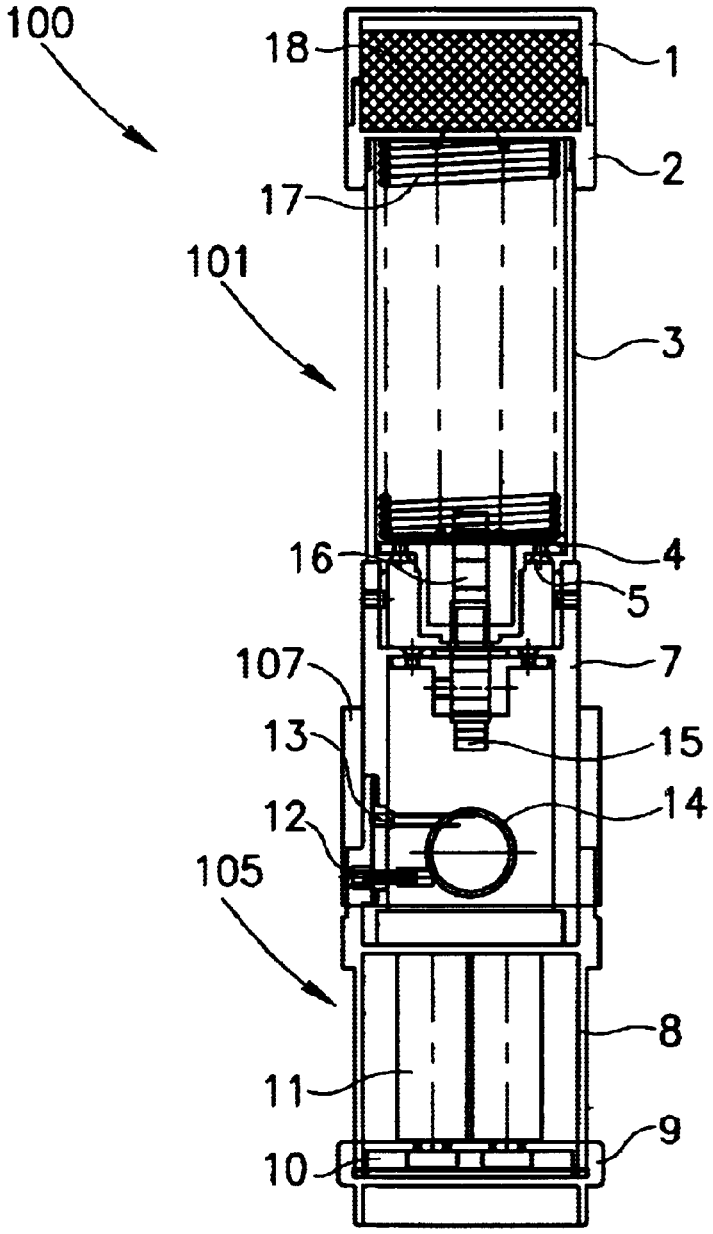

Reference is now made to FIGS. 3A and 3B, which illustrate that the actuator apparatus 100 may be advantageously incorporated into an actuator-wire-detonator system 110. In this embodiment, the first portion of the coil 17 preferably comprises a quick-connect electrical connector 16, which is arranged for electrical connection with electrical connector 15, which comprises a corresponding quick-connect electrical connector. For example, quick-connect electrical connector 16 may be a female connector that mates with connector 15 which is a corresponding male connector. Conversely, connector 16 may be the male connector and connector 15 may be the female connector. The pair of quick-connect electrical connectors are preferably adapted to be connected together (and disconnected) with a motion in one direction, such as but not limited to, a push-pull linear direction or twist motion.

It is noted that in the embodiment of FIGS. 3A and 3B, an adapter 2, such as but not limited to, a short cylindrical element, may be employed to effect a tight fit between the cap element 1 and the housing 3. The quick-connect electrical connector 16 may be mounted in housing 3 by a variety of means, such as but not limited to, a bracket 4 and one or more screws 5.

A control device 105 is preferably adapted to be electrically connected to actuator 101. The control device 105 preferably includes a housing, which may comprise two housing portions 7 and 8. Housing portion 8 preferably houses a power source 11, such as but not limited to, one or more batteries, adapted to provide power for actuator 101 and the other electrical components of the system 110. Housing portion 8 may accordingly be provided with a battery cover 9 and a battery plate 10 for secure and watertight electrical connection of the batteries.

The quick-connect electrical connector 15 is preferably mounted in or on housing portion 7, and is in electrical communication with control circuitry and components, which are preferably housed in housing portion 7, for controlling actuation of the actuator 101. For example, the control circuitry and components may include one or more safety switches 14, LEDs 13 and a circuit board 106. Different combinations of throwing the switches 14 may correspond to different functions of the control device 105. For example (although the invention is not limited to this example), there may be two press-switches 14. Pressing one of the switches may check the operating condition of the batteries (power source 11). Pressing the other switch may check the operating condition of the circuit board 106. Only by pressing both switches will the control device 105 provide power to actuate the actuator 101 and consequently the detonators 18. The LEDs 13 may be differently colored to indicate the different functions.

The system 110 may include additional safety features, such as a safety pin 12 which must be removed before actuation of the control device 105. In other words, the safety pin 12 may have first and second positions, wherein in the first position the safety pin 12 substantially prevents actuation of the actuator apparatus 100 (or system 110), and wherein in the second position the safety pin 12 permits actuation of the actuator apparatus 100 (or system 110). The safety pin 12 may be used as an element that electrically shorts the system 110 until its removal.

Yet another safety feature may comprise a sleeve 107 that slides over the switch area of the control device 105. The sleeve 107 may cover the switch area before use of the system 110, so as to prevent accidental operation of the system and to protect against the environment. When it is desired to operate the system 110, a user simply slides the sleeve 107, such as in the direction of an arrow 108, to expose the switches 14.

The housing portions 7 and 8 of the control device 105, as well as the housing 3 of the actuator 101, may be shielded from EMI (electromagnetic interference), so as to prevent spurious signals from other electrical devices, telecommunication devices, lightning and the like (not shown), in the vicinity of the actuator system 110 from interfering with the operation of the actuator system 110.

In a preferred embodiment of the present invention, the actuator-wire-detonator system 110 may not require a capacitor to build up charge for supplying power to the actuator 101. This provides a further advantage over the prior art, because there is no time delay associated with a capacitor.

Figure 4:
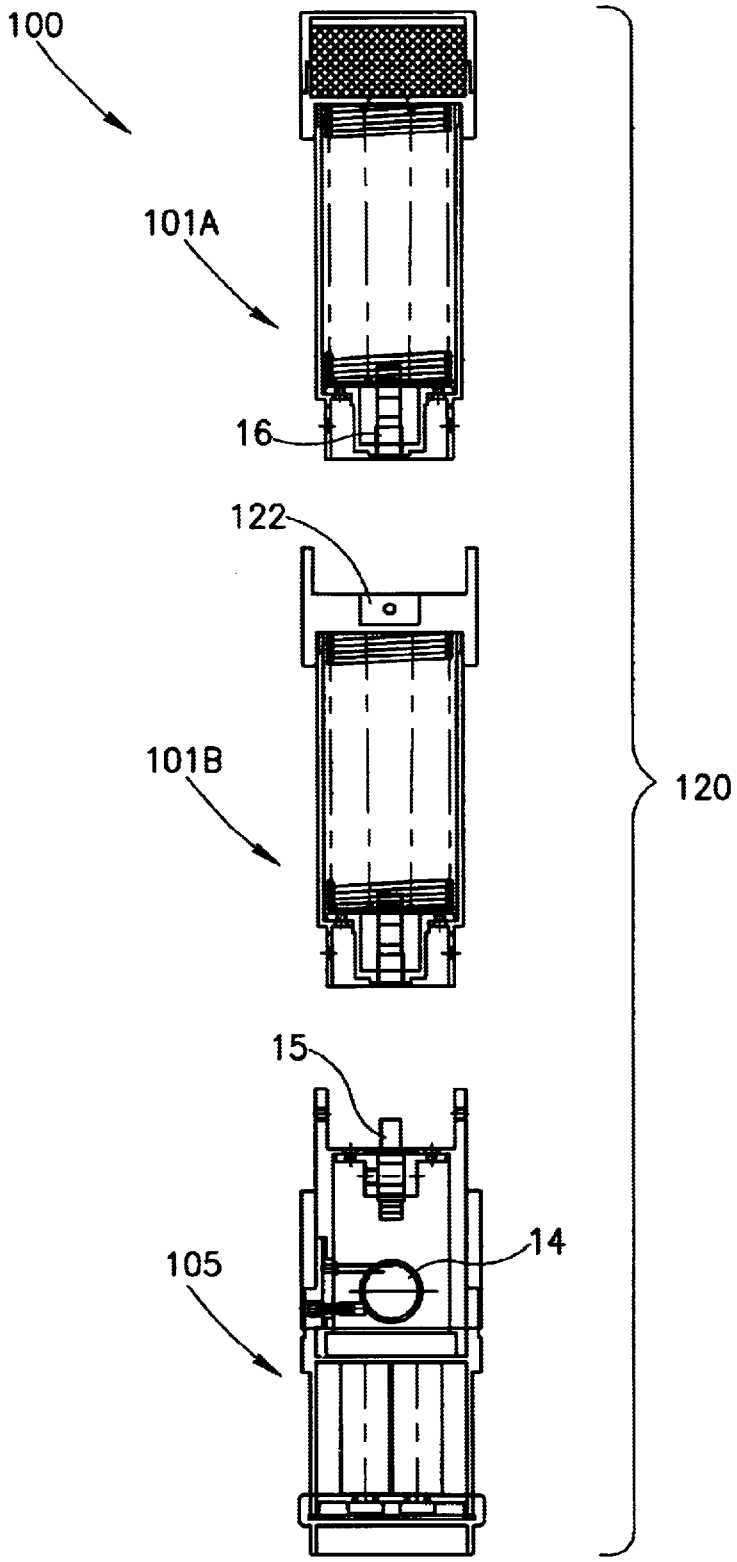
FIG. 4 is a simplified exploded illustration of an actuator-wire-detonator system, constructed and operative in accordance with another preferred embodiment of the present invention, wherein one actuator may be connected to another actuator before connecting to a control device of the system.

Reference is now made to FIG. 4, which illustrates an actuator-wire-detonator system 120, constructed and operative in accordance with another preferred embodiment of the present invention. In system 120, several actuators may be connected to together before connecting to control device 105. For example, a first actuator 101A may be connected to a second actuator 101B, and second actuator 101B may be then connected to control device 105. The combination of the two or more actuators may serve to extend the overall length of the system 120. The connection between the actuators may be mechanical only, or may also be electrical. For example, as shown in FIG. 4, first actuator 101A may be connected to second actuator 101 B by means of connector 16 mating with another connector 122 to which coil 17 of second actuator 101B is connected.

Figure 5:
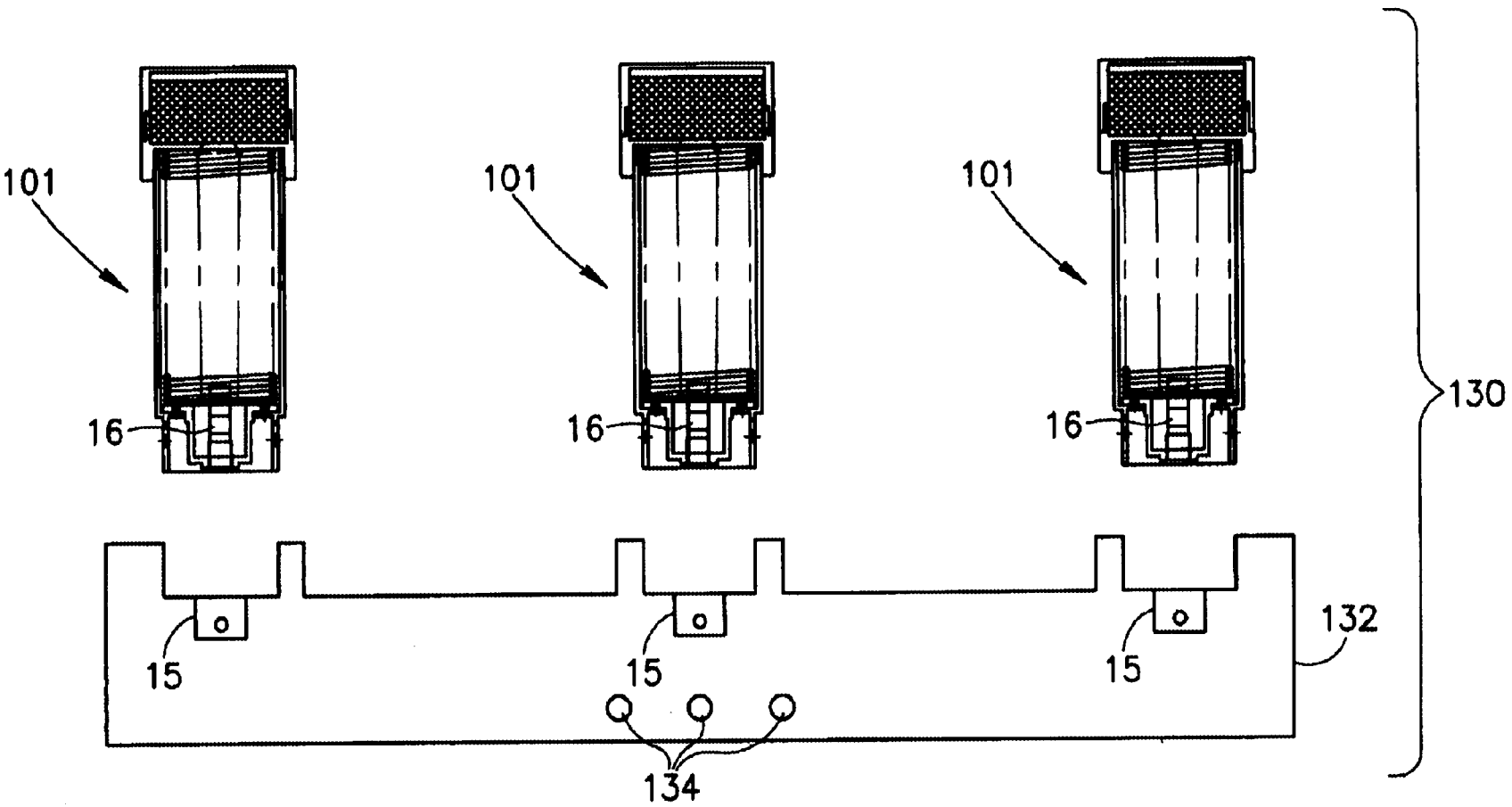
FIG. 5 is a simplified exploded illustration of an actuator-wire-detonator system, constructed and operative in accordance with another preferred embodiment of the present invention, wherein multiple actuators may be connected to the control device of the system.

Reference is now made to FIG. 5, which illustrates an actuator-wire-detonator system 130, constructed and operative in accordance with yet another preferred embodiment of the present invention. System 130 preferably includes a multiple control device 132, adapted for connection to a plurality of actuators 101. Control device 132 preferably includes a plurality of connectors 15 spaced apart from one another for connection with corresponding connectors 16 of the actuators 101. Control device 132 may be equipped with various control buttons 134 for operating the actuators 101 either individually or in groups or all together.

It will be appreciated by person skilled in the art that the present invention is not limited by what has been particularly shown and described herein above. Rather the scope of the present invention is defined only by the claims that follow:

What is claimed is:

1. Actuator apparatus comprising:

an actuator comprising an at least partially hollow housing;

a cap element removably mountable on said actuator;

a coil of electrical wire disposed inside said at least partially hollow housing, a first portion of said coil of electrical wire being arranged for electrical connection with an electrical connector separate from said actuator and a second portion of said coil of electrical wire being arranged for electrical connection with said cap element, said coil of electrical wire being unwindable outwards from said at least partially hollow housing; and a control device adapted to be electrically connected to said actuator and comprising a power source adapted to provide power for said actuator, wherein said power source provides power for actuating said actuator free of a capacitor.

2. The actuator apparatus according to claim 1 wherein said control device and said actuator comprise mating quick-connect electrical connectors adapted to bring said control device and said actuator into electrical communication with one another.

3. An actuator-wire-detonator system comprising:

at least two actuators each comprising an at least partially hollow housing;

a coil of electrical wire disposed inside said at least partially hollow housing, said coil of electrical wire being unwindable outwards from said at least partially hollow housing; and a control device electrically connectable to said actuator and said coil of electrical wire;

wherein said at least two said actuators are connected together and one of said actuators is also connected to said control device.

4. The actuator-wire-detonator system according to claim 3 wherein said control device is adapted to mate with a plurality of said actuators.

5. Actuator apparatus comprising:

an actuator comprising an at least partially hollow housing;

a cap element removably mountable on said actuator;

a coil of electrical wire disposed inside said at least partially hollow housing, a portion of said coil of electrical wire being arranged for electrical connection with said cap element, said coil of electrical wire being unwindable outwards from said at least partially hollow housing; and a control device adapted to be electrically connected to said actuator, wherein said control device and said actuator comprise mating electrical connectors adapted to bring said control device and said actuator into electrical communication with one another, and wherein at least one of the mating electrical connectors is electrically shorted until the mating electrical connectors are mated.

6. The actuator apparatus according to claim 5, further comprising a safety pin that electrically shorts at least one of the mating electrical connectors until removal of said safety pin.

7. The actuator apparatus according to claim 5, wherein said mating electrical connectors comprise mating quick-connect electrical connectors.

8. The actuator apparatus according to claim 6, wherein said safety pin has first and second positions, wherein in the first position said safety pin substantially prevents actuation of said actuator apparatus and wherein in the second position said safety pin permits actuation of said actuator apparatus.

* * * * *